United States Patent [19]

Todokoro

[11] 4,175,742

[45] Nov. 27, 1979

[54] GAME BOARD

[76] Inventor: Masatoshi Todokoro, 2-33 Koganehara 2-chome, Matsudo, Chiba, Japan, 270

[21] Appl. No.: 861,123

[22] Filed: Dec. 16, 1977

[30] Foreign Application Priority Data

Jul. 29, 1977 [JP] Japan ..... 52/101368[U]

[51] Int. Cl.[2] ..... A63F 9/14

[52] U.S. Cl. ..... 273/1 R; 273/86 F

[58] Field of Search ..... 273/1 R, 1 E, 1 M, 85 R, 273/86 F

[56] References Cited

U.S. PATENT DOCUMENTS

| | | | |
|---|---|---|---|
| 2,526,215 | 10/1950 | Florimont | 273/86 F |
| 2,917,310 | 12/1959 | Durrell | 273/85 R |
| 3,222,066 | 12/1965 | Durrell | 273/85 R X |
| 3,441,277 | 4/1969 | Winn | 273/86 F |
| 3,827,693 | 8/1974 | Barlow et al. | 273/86 F |

FOREIGN PATENT DOCUMENTS

| | | | |
|---|---|---|---|
| 1458596 | 10/1966 | France | 273/85 R |
| 1446645 | 8/1976 | United Kingdom | 273/85 R |

*Primary Examiner*—Paul E. Shapiro

*Attorney, Agent, or Firm*—George B. Oujevolk

[57] ABSTRACT

A game having a base with a number of slots in its top surface. A bar is positioned astride said slots and has rods pivotally suspended therefrom over said slots. Each rod has an object magnetically attached to its lower end. Each slot overlies a manually movable endless belt. Each belt carries an animated figure a portion of which can rise above the base to remove an object. The body portion of each figure has therein a vertically movable bar which projects out from the underside of the base and is spring biased to its lowermost position. The portion of the bar in the body is sheathed by a slide cylinder. A split hollow head portion is pivotally joined to the upper end of the cylinder and is opened and closed in response to relative vertical movement of said vertically movable bar in the cylinder. A first spring disposed between the vertically movable bar and the slide cylinder permits limited relative vertical movement between the bar and cylinder to open the head. A second spring normally presses the cylinder against the bar for concurrent movement after initial relative movement but disengages from the cylinder when the batter ascends a predetermined distance together with the bar, and the first spring then returns the bar and cylinder to their initial relative positions, closing the head. A push-up bar is positioned along the area of passage of each vertically movable bar to operate it.

7 Claims, 8 Drawing Figures

GAME BOARD

This invention relates to a game board for a game copied from the "bread-snap-and-run" race which is a familiar event in school sports or other athletic meets.

The invention is described in detail hereinbelow by way of an embodiment thereof as illustrated in the accompanying drawings, in which.

Figure 1:
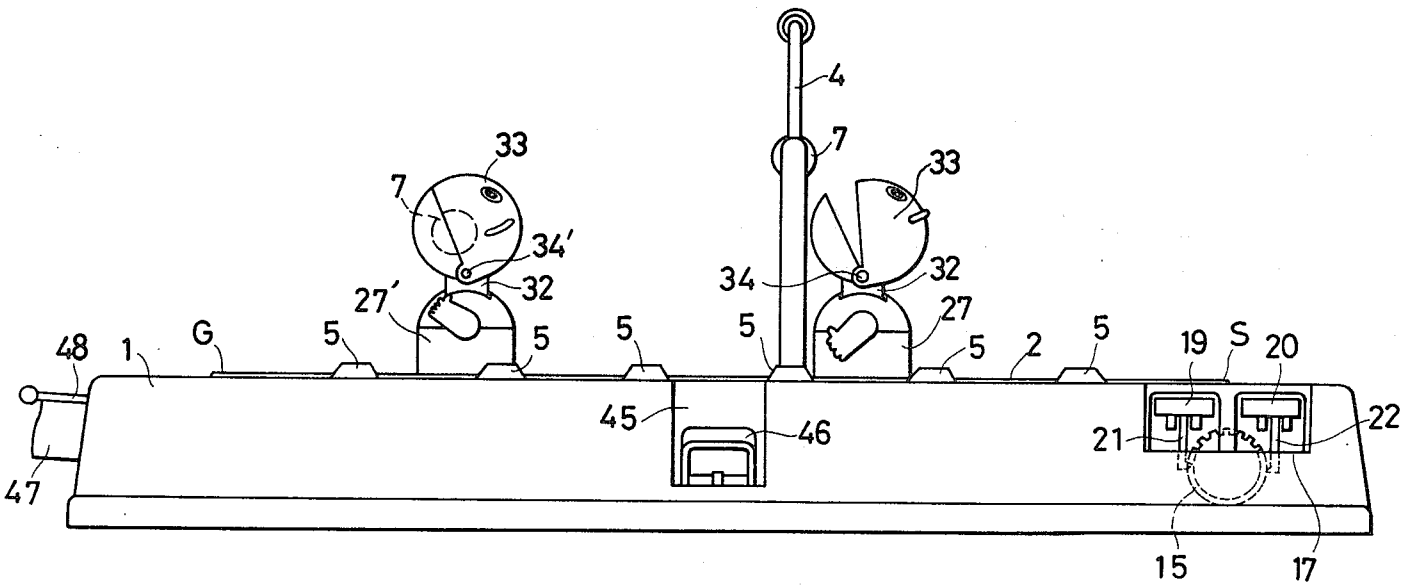
FIG. 1 is a side view of a game board according to this invention.
Figure 2:
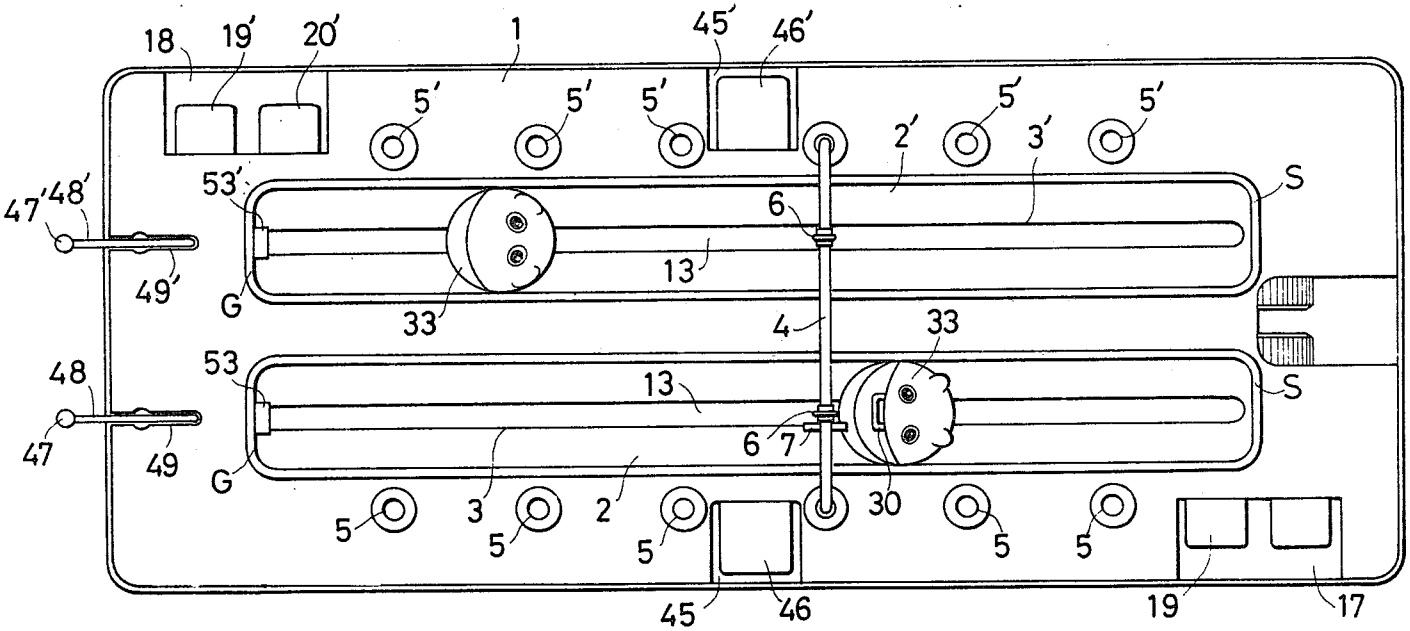
FIG. 2 is a top plan view thereof.
Figure 3:
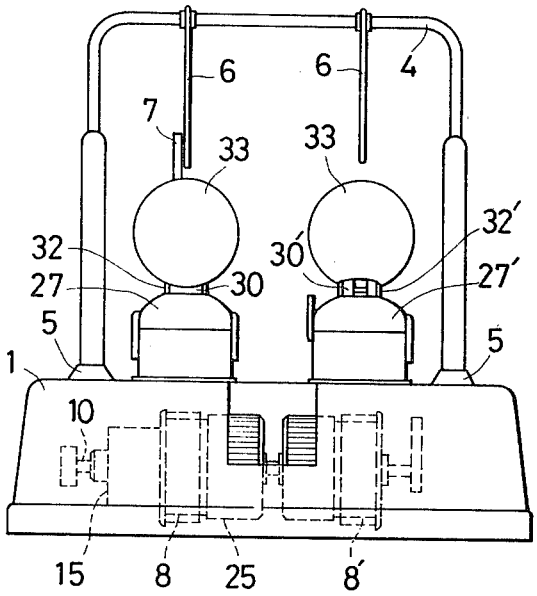
FIG. 3 is a right-hand side view of the device shown in FIG. 1.
Figure 4:
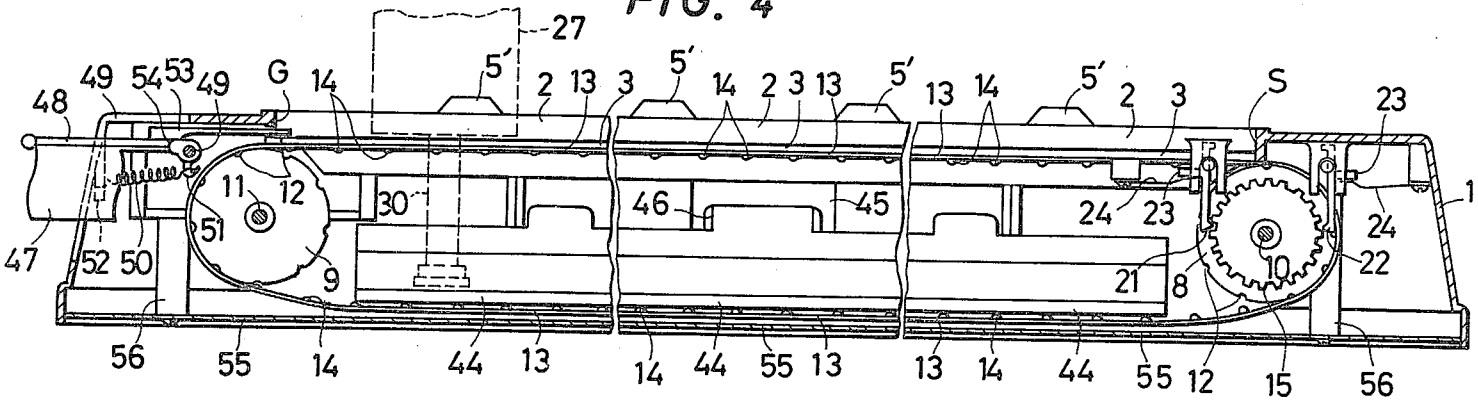
FIG. 4 is a partially cut-out enlarged vertical sectional view of the device.
Figure 5:
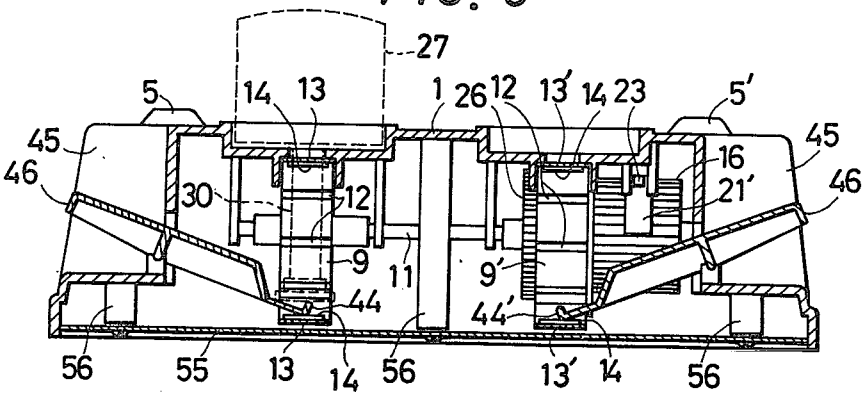
FIG. 5 is an enlarged cross-sectional view thereof.

Referring generally to the drawings, reference numeral 1 designates generally the base board having formed in its top surface plate a suitable number of recessed lanes 2, 2' extending parallel to the length of said top plate, with one end S of each of said lanes being designed to serve as start and the other end G as goal. Each of said lanes 2, 2' is formed centrally thereof with an elongated slot 3, 3' extending along the bottom center line of the lane. Numeral 4 indicates a gallows-like bar provided bestriding the lanes 2, 2'. Said bar 4 has a horizontal portion extending transversely over the elongated slots 3, 3' and is so designed that it can be set to any pair of supports 5, 5' provided in six pairs (in the shown embodiment) equidistantly from each other along both sides of the top surface of the base board 1. Suspending swingably from the horizontal portion of said bar 4 are metal-made rods 6, 6' positioned in opposition to the respective elongated slots 3, 3'. Attached magnetically to the lower end of each of said suspending rods 6, 6' is an object to be caught 7, 7' copied after a bun or such. Two pairs of belt pulleys 8, 9 and 8', 9' mounted on the respective shafts 10, 11 are provided inside of the base board 1 in close adjacency to both ends of said respective elongated slots 3, 3', each of said belt pulleys being formed peripherally thereof with a suitable number of equidistantly spaced dents 12. Passed round and between said belt pulleys 8, 9 and 8', 9' are endless belts 13, 13' each of which is provided with protuberance 14 designed to fit into said dents 12 in said belt pulleys. Driving gears 15 and 16 are mounted coaxially with the belt pulleys 8 and 9' which are positioned diagonally to each other. The parts 17, 18 of the upper surface of the base board corresponding to said driving gears 15, 16 are recessed. Numerals 19, 20 and 19', 20' indicate two pairs of transfer levers, with one end of each said lever being pivotally supported in the inside of base board and the other end projecting into said corresponding recession 17 (18). One of each of said pairs of transfer levers 19, 19' is provided with a feed bar pawl 21 (21') which is so arranged that whenever any said transfer lever is pushed, the corresponding bar pawl is engaged with one side of the associated driving gear to let it turn forwardly by one pitch. The other lever 20 (20') is provided with a similar bar pawl 22 (22') so arranged that whenever the lever is pushed, the corresponding pawl is engaged with the other side of the associated driving gear to let it turn rearwardly by one pitch. Each of said feed bar pawls, as shown in FIG. 4, is provided with a protuberance 23 against which one end of a leaf spring 24 is pressed to let the pawl normally stay at a position slightly apart from the associated driving gear. The other end of said leaf spring 24 is fixed to the base board 1.

Numerals 25 and 26 denote gears mounted on the side opposite from the driving gear side of the belt pulleys 8 and 9', each of said gears 25, 26 being engaged with a spring-loaded pawl (not shown) to ensure perfect transmission of pitch-by-pitch turn of the driving gear to the associated belt pulley. Denoted by numeral 27 (27') is the body of an animated figure, with the bottom portion of said body being fitted in the corresponding recessed lane 2 (2') and set on the endless belt 13 (13') through a mounting plate 28. It is secured to the endless belt by means of screws 29 driven thereinto from the underside of the belt. 30 (30') is a bar which extends from the top of the body 27 (27') to its bottom and further projects out from the underside of the base board 1. Said bar 30 (30') is supported so as to be movable up and down. A coil spring 31 is loaded around the projected-out portion of each said bar 30 (30') to urge it to its lowermost position. The portion of each said bar 30 (30') extending in the body 27 (27') is sheathed by a slide cylinder 32 (32'). The head portion 33 (33') of the animated figure is a hollow spherical structure which is split at the mouth portion, with the lower jaw side 33A (33A') of said structure being fixed to the upper end of the associated slide cylinder 32 (32') while the upper jaw side 33B (33B') is pivotally joined, at 34 (34'), to the upper end of the slide cylinder 32 (32') so that the upper jaw side is openable and closable relative to the fixed lower jaw side.

An upper jaw opening and closing lever 35 is provided projecting into the upper jaw side portion 33B (33B') of the head portion or object capturing portion 33 (33'), with the end of said lever being engaged in a hole 36 formed toward the upper end of the bar 30 (30'). 37 is a leaf spring having its one end fixed to the vertical bar 30 (30'), with the other end of said leaf spring being pressed against a stepped portion 38 provided on the inner wall of the slide cylinder 32 (32') to urge said cylinder to keep the head portion 33 (33') normally closed. 39 is another leaf spring having its one end fixed to a support block 40 provided at the bottom portion of the body 27 (27'), with the other end of said another leaf spring being pressed against a protuberance 41 provided in the top inside of the body 27 (27'). A bend 42 is formed toward the other end of said leaf spring 39 so that said bend 42 fits in a corresponding recession 43 provided in the corresponding side of the slide cylinder 32 (32'). When the bar 30 (30') is raised up, said bend 42 slidingly presses against the side of the slide cylinder 32 (32') to press it against the bar 30 (30'), and when the slide cylinder 32 (32') ascends by an amount equal to the distance from the recession 43 to the lower end, said bend 42 comes off the side of the slide cylinder 32 (32') to its lower end to release pressure against the bar 30 (30') and push up the slide cylinder 32 (32') to its uppermost position. 44 and 44' are push-up bars each of which is provided inside the base board 1 along the range of passage of the lower end of the bar 30 (30') and has provided at its middle part a push-up lever 46 (46') which projects into a corresponding recession 45 (45') provided at the middle part of each side of the base board 1. Projecting from the goal side end of the base board 1 are flag plates 47, 47'. The support rod 48 (48') of each of said flag plates 47, 47' has its end inserted into the inside of the base board 1 through a hole 49 (49') formed on the extension line of each elongated slot 3 (3') at the goal side end of each lane 2 (2'), with the inserted end of said support rod 48 (48') being pivoted at 49. Disposed between a protuberance 51 from the pivoted portion 49 of each said flag plate 47 (47') and a corresponding protuberance 52 on the inner wall of the base board 1 is a coil spring 50 which urges the flag plate 47 (47') to its raised up position above the base board 1. 53 and 53' are control bars each of which has its one end urged to project out from the goal end G of each lane recession 2 (2') and has its other end pressed against a cam 54 provided at the pivoted end 49 of each flag plate 47 (47') to force down the flag plate 47 (47') to its horizontal position against the force of the coil spring 50. 55 is a bottom plate covering the bottom surface of the base board 1, and 56 is support posts adapted to support said bottom plate 55.

In using of the game board of this invention having the above-described arrangements, first the transfer levers 20, 20' are pushed repeatedly to reversely rotate the driving gears 15, 16 pitch by pitch by the bar pawls 22, 22', and the rotation of said driving gears is transmitted to the belt pulleys 8, 9' to move the endless belts 13, 13' from the goal end G to the start end S of the respective lanes 2, 2' so that the body portions 27, 27' of the animated figures on the respective endless belts 13, 13' are positioned at the start end S of the respective lanes 2, 2'. Then both ends of the bestriding bar 4 is set into any selected pair of supports 5, 5' to decide the supported position of the bar 4, and then the objects to be caught 7, 7' are magnetically attached to the lower ends of the respective suspending rods 6, 6' from the bar 4. The board is now ready to start the game.

Figure 8:
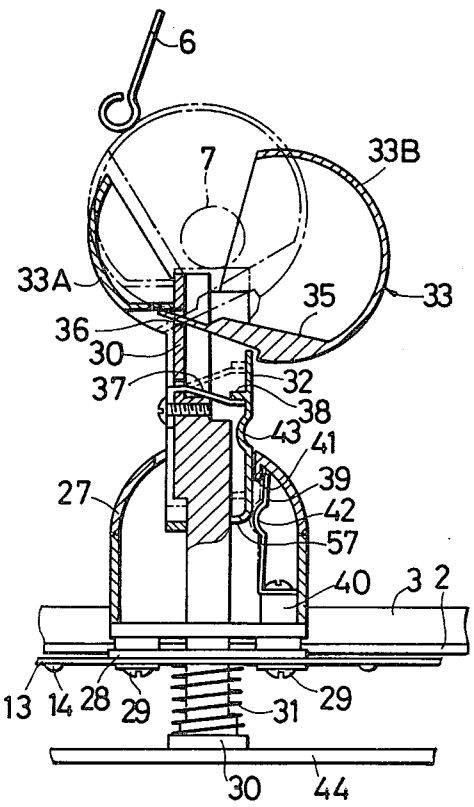
FIG. 8 is also a similar view in a condition where said bar was pushed up to its uppermost position so that the head portion of the animated figure will be able to capture an object to be caught.
Figure 7:
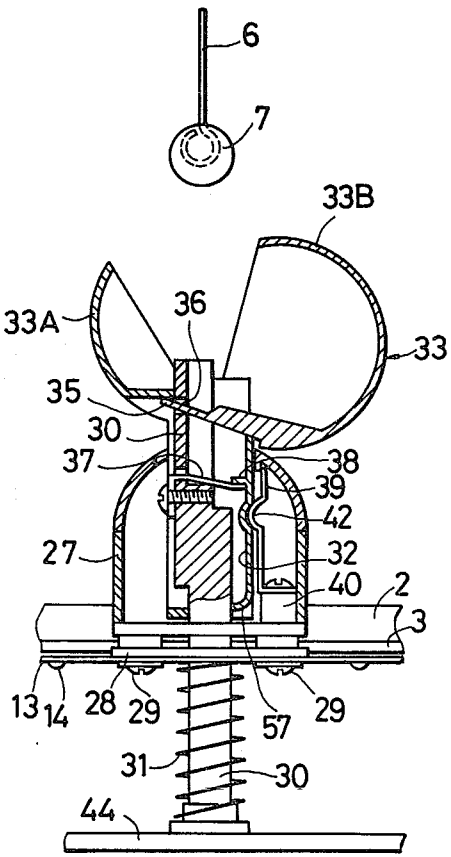
FIG. 7 is a similar view in a condition where said bar is being pushed up.
Figure 6:
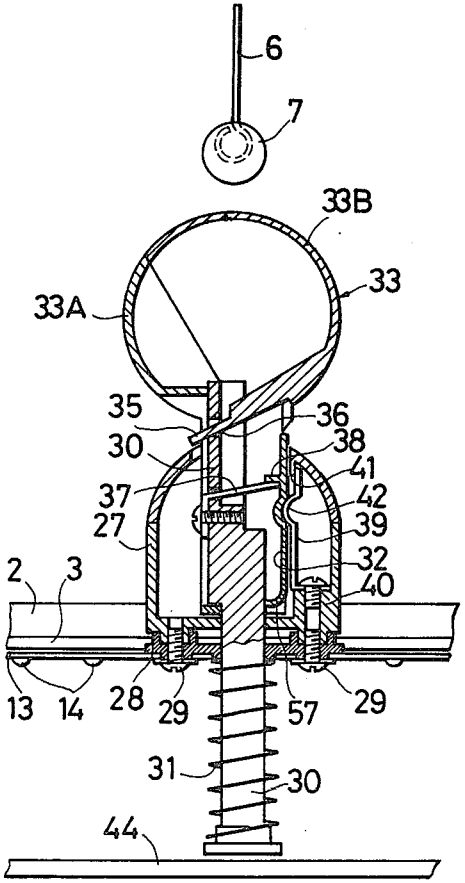
FIG. 6 is a sectional view of an animated figure assembly in a condition where the vertically movable bar is in its lowermost position.

The two players push the respective transfer levers 19, 19' repeatedly to rotate the driving gears 15, 16 forwardly pitch by pitch by the feed pawls 21, 21', with the rotation of said driving gears being transmitted to the belt pulleys 8, 9' to let the respective endless belts 13, 13' move from the start end S toward the goal end G of the respective lanes 2, 2', whereby the animated figures on said respective endless belts are also moved toward the goal end. When any animated figure came close to the bestriding bar 4, its operator (player) pushes the push-up lever 46 (46') momentarily, whereby the bar 30 (30') is pushed up against the coil spring 31. Accordingly, the upper jaw opening and closing bar 35 in the head portion 33 (33') is first forced up to let the upper jaw side portion 33B (33B') swing open about the pivot 34 (34') as shown in FIG. 7. Then the movement of said bar 30 (30') is transmitted to the associated slide cylinder 32 (32') through the flexed leaf spring 37 to let said slide cylinder rise up together with the bar 30 (30'), with the upper jaw side 33B (33B') of the head portion being kept to its open position, and when the slide cylinder rises up to a position where its lower end has just passed the height of the bulge (bend) 42 of the leaf spring 39, said bulge 42 comes off the side of the slide cylinder and slides down to the lower end face 57 of said cylinder as shown by the solid line in FIG. 8, whereby pressure of the slide cylinder against the bar 30 (30') is released and the slide cylinder 32 (32') is quickly raised up to its uppermost position shown by the chain line in FIG. 8 under the elastic force of the leaf spring 37, thus giving the upper jaw opening and closing bar 35 a force acting to close the upper jaw side 33B (33B'), thereby forcing the upper jaw side of the head portion to its closed position shown by the chain line in FIG. 8. During this action, if the upper jaw side 33B (33B') is closed at the position where it coincides with the object to be caught 7 (7'), said object is captured in the head portion 33 (33'), but if the upper jaw side is closed at the position where it does not coincide with the object to be caught, said object is not captured but remains attached to the suspending rod 6 (6').

When the upper jaw side portion 33B (33B') is brought to its closed position, the bar 30 (30') is forced down to its original position under the pressure of the coil spring 31, so that the slide cylinder 32 (32') is also lowered down to its original position, with the head portion 33 (33') being kept closed.

The player who has succeeded in capturing the object 7 (7') pushes again the transfer lever 19 (19') repeatedly to let the animated figure 27 (27') move toward the goal end G, while the player who failed to capture the object corrects the position of the animated figure and/or adjusts the operation of the push-up lever 46 (46') and then repeats the capturing operation, and when he succeeded in capturing the object, he again repeats pushing of the transfer lever 19 (19') to let the animated figure 27 (27') move to the goal end G.

When the animated figure 27 (27') reaches the goal end, the end of the mounting plate 28 hits against the control bar 53 (53') and pushes it against the spring traction, whereby pressure of the cam 54 thereagainst is released, allowing the flat plate 47 (47') to spring up to its upright position above the base board by the elastic action of the coil spring 50. The player who is first in erecting the flat plate 47 (47') is the winner.

The animated figure, head portion and object to be caught shown and described above are the mere examples and they may take any other suitable configurations. Also, the movement of the endless belt, which is effected intermittently pitch by pitch by means of a driving gear in the above-described embodiment, may be effected continuously by using a windup spring, motor or other means. it is also possible to set two or more bestriding bars along the elongated slots.

Being constructed as described above, the game board according to this invention allows the children to enjoy the small miniature "bread-snap-and-run" race with a simple operation.

What is claimed is:

1. A game board comprising in combination:

(a) a base board with an upper surface and an underside, a suitable number of elongated slots defined in said upper surface;

(b) a bar with a horizontal portion bridging said elongated slots, said bar having rods suspended from said horizontal portion opposite said respective elongated slots, said rods having a lower end, each of said rods having magnetically attached to said lower end an object to be caught;

(c) endless belts along said slots and moving means to move said endless belts along said respective elongated slots, and moving means being provided at the underside of said base board beneath said respective elongated slots, each of said belts having thereon an animated figure with a body portion so disposed that said body portion rises above said upper surface;

(d) a first bar supported in the body portion of each of said animated figures so as to be vertically movable, said first bar having a bar portion extending from the top of said body portion to its bottom and a projecting portion projecting out from the underside of the base board, the projecting portion of said bar being loaded with a bias spring adapted to force said bar to its lowermost position while the bar portion extending in the body portion of each of said animated figures is sheathed by a slide cylinder, said slide cylinder being mounted with a hollow head portion of the animated figure, said head portion being split so that it may open, said head portion also having a second bar engaged with said first bar so as to open or close the head portion in accordance with the movement of said vertically movable first bar;

(e) a first spring disposed between the vertically movable first bar and the associated slide cylinder, said first spring urging said slide cylinder to close the head portion of the animated figure;

(f) a second spring disposed between each of said slide cylinders and the body portion of each animated figure, said second spring being adapted to press said slide cylinder against said first bar when the latter moves up and to disengage said first bar from said slide cylinder when the slide cylinder has ascended a predetermined distance together with said first bar; and, d (g) a push-up bar provided horizontally along the area of passage of the lower end of each of said vertically movable first bars, said push-up bar being adapted to push up said vertically movable first bar.

2. A game board as claimed in claim 1, including belt pulleys in pairs, pivotally mounted inside the base board adjacent both ends of said elongated slots, said endless belts being passed around said pulleys; one of said pair of belt pulleys being coaxially provided with a driving gear, and, a pair of transfer levers mounted adjacent to said driving gear, one of said transfer levers being provided with a feed bar pawl adapted to let said driving gear turn forwards by one pitch upon each push of one lever, the other of said transfer levers being also provided with a similar feed pawl but adapted to set said driving gear turn in reverse by one pitch upon each push of the other lever.

3. A game board as claimed in claim 2, said first bar having an engagable aperture at a mouth upper end, said split hollow head portion defining amouth of the animated figure with a lower jaw side portion fixed to the upper end of the associated slide cylinder, an upper jaw side portion being also defined and pivotally joined to the upper end of said slide cylinder so that said upper jaw side portion may swing open relative to the lower jaw side portion, and, the end of the second bar for opening and closing the upper jaw, projecting into said upper jaw side portion and engaging said aperture in said first bar.

4. A game board as claimed in claim 3 wherein the suspending rods are swingably joined to the horizontal portion of each of said bars bridging said slots.

5. A game board as claimed in claim 4, said belt pulleys having on the periphery thereof a suitable number of spaced-apart equidistant recesses and each of said endless belts having a suitable number of protuberances which engage said recesses.

6. A game board as claimed in claim 5, said push-bars being disposed in the inside of the base board and along the travel path of the lower ends of the vertically movable bars, each of said push-bar having a push-up lever which extends out from the middle part of said push-bar.

7. A game board as claimed in claim 6, said base board having an inner wall and also having a retaining aperture disposed on a line extending from an end of each elongated slot, a flag plate support bar inserted into each of said apertures, the inserted end of said support bar being pivotally secured therein, a coil spring disposed said pivoted portion and said opposed inner wall, said coil spring being disposed to normally force the flag plate bar to an erect position above the surface of the base board, said pivoted portion including a cam, and, a control bar extending from said elongated slot to said cam to force said flag plate bar to a horizontal position against the opposing force of said coil spring.

* * * * *